US011377921B2

(12) United States Patent
Burca

(10) Patent No.: US 11,377,921 B2
(45) Date of Patent: Jul. 5, 2022

(54) SLOT RECOVERY METHOD

(71) Applicant: Heather Burca, Calgary (CA)

(72) Inventor: Dennis Burca, Calgary (CA)

(73) Assignee: Heather Burca, Calgary (CA)

( * ) Notice: Subject to any disclaimer, the term of this patent is extended or adjusted under 35 U.S.C. 154(b) by 121 days.

(21) Appl. No.: 16/618,455

(22) PCT Filed: May 24, 2016

(86) PCT No.: PCT/CA2016/050583
§ 371 (c)(1),
(2) Date: Dec. 2, 2019

(87) PCT Pub. No.: WO2017/201601
PCT Pub. Date: Nov. 30, 2017

(65) Prior Publication Data
US 2020/0408056 A1 Dec. 31, 2020

(51) Int. Cl.
*E21B 29/12* (2006.01)
*E21B 10/567* (2006.01)
(Continued)

(52) U.S. Cl.
CPC ..... *E21B 29/12* (2013.01); *E21B 10/567* (2013.01); *E21B 29/005* (2013.01); *E21B 33/13* (2013.01)

(58) Field of Classification Search
CPC ..... E21B 29/12; E21B 29/005; E21B 29/02; E21B 29/04; E21B 29/06; E21B 10/567;
(Continued)

(56) References Cited

U.S. PATENT DOCUMENTS 2,827,264 A * 3/1958 Sitton ..... E21B 10/64 175/398
3,217,816 A * 11/1965 Boyer ..... B23B 51/0426 175/57

(Continued)

FOREIGN PATENT DOCUMENTS

WO WO-2014150524 A2 * 9/2014 ..... E21B 23/006

OTHER PUBLICATIONS

International Search Report and Written Opinion of the International Searching Authority Application No. PCT/CA2016/050583 Completed: Jan. 11, 2017 7 Pages.

*Primary Examiner* — Giovanna Wright
*Assistant Examiner* — Yanick A Akaragwe
(74) *Attorney, Agent, or Firm* — Whitmyer IP Group LLC

(57) ABSTRACT

The present concept is a method of slot recovery for the oil industry. The method involves running an internal cutter down the production casing to cut through a preselected number of existing casings at predetermined depths before drilling around the outermost preselected casing with a hollow drill bit. The hollow drill bit drills through the preslected outermost casing cement to the predetermined depth before a removal tool attached to the inside of the production casing is used to remove the existing casings to the predetermined depth. These steps are repeated using appropriately sized hollow drill bits and casings to drill around the next preselected outermost casings to the next predetermined depth, continuously removing the existing casings until all desired existing casings are removed.

20 Claims, 14 Drawing Sheets

(51) Int. Cl.
*E21B 29/00* (2006.01)
*E21B 33/13* (2006.01)

(58) Field of Classification Search
CPC ..... E21B 10/02; E21B 10/04; E21B 10/06; E21B 33/13; E21B 31/00
See application file for complete search history.

(56) References Cited

U.S. PATENT DOCUMENTS

| | | | | |
|---|---|---|---|---|
| 4,007,797 | A | 2/1977 | Jeter | |
| 4,431,068 | A * | 2/1984 | Dellinger | E21B 7/04 175/61 |
| 5,038,859 | A * | 8/1991 | Lynde | E21B 10/46 166/55.6 |
| 5,373,900 | A * | 12/1994 | Lynde | B23B 5/16 166/297 |
| 5,437,340 | A * | 8/1995 | Lee | E21B 7/061 166/117.6 |
| 6,729,416 | B2 | 5/2004 | Contreras et al. | |
| 7,762,330 | B2 | 7/2010 | Saylor, III et al. | |
| 9,194,200 | B2 | 11/2015 | Orstad | |
| 2013/0199785 | A1 * | 8/2013 | Hekelaar | E21B 29/005 166/298 |
| 2014/0000911 | A1 * | 1/2014 | Gorrara | E21B 19/16 166/380 |
| 2014/0231087 | A1 * | 8/2014 | Orstad | E21B 7/18 166/298 |
| 2015/0315863 | A1 * | 11/2015 | Vail, III | E21B 3/00 175/57 |
| 2018/0328118 | A1 * | 11/2018 | Morse | E21B 10/5673 |

* cited by examiner

Slot Recovery Method

Figure 13

Slot Recovery Method 300

Run an internal cutter down the production casing to cut through preselected number of existing casings in a casing string at a predetermined depth. The internal cutter could be an internal multi string cutter to mill through production and intermediate casings and not for example cut the existing conductor casing. The internal cutter nay be an internal mechanical cutter, hydraulic jetting cutter or explosives or other cutting methods used to laterally cut existing casings into sections at predetermined depths intervals required for later withdrawal. 302

Connect the hollow drill bit to core over casings. The length of the core over casings will depend on the predetermined depths. The hollow drill bit may be a PDC, Carbide (TCI), diamond impregnated or other formation dependent drill bit. 304

Assemble components from hollow drill bit, core over casing and optionally a cross over subassembly to cross over to the drill string in which case one can add drill collars, drill rod and use the drill string in the conventional method Add drill collars as needed to provide enough weight on the bit and then add drill rod using conventional methods. 306

Provided the intermediate casing is not too far off center one can drill around the intermediate casing, using an appropriately sized hollow drill bit, down to the predetermined depth leaving the existing conductor casing in place. 308

SLOT RECOVERY METHOD

FIELD OF THE INVENTION

The present concept relates to methods of slot recovery in the offshore drilling technology sector and more particular a SLOT RECOVERY METHOD in the oil drilling technology sector.

BACKGROUND OF THE INVENTION

There typically are a limited number of slots available for use on an offshore platform. Slot recovery enables reusing a plugged or non-producing well slot to drill for additional resources from the existing offshore surface structure. These types of operations typically involve mechanically removing a section of casing followed by forming an open holed side track or a casing exit provided by a large diameter whipstock and mill combination. The term slot recovery is used to mean a process which involves removal of old and used inner strings of casing and also potentially the outer most conductor casing if required. Strings of casings are normally are cemented to each other to stabilize the structure. In a slot recovery operation the inner strings of casing and at times the conductor casings are to be removed safely and as quickly as possible. The task normally has to be completed within a short span of time.

Current methods of removing intermediate casings involve normally milling all of the old casing except for the old outer casing which often is a 30 inch conductor. Once the inner casing sections are milled often the existing outer conductor casing is used to drill a new well. In some cases the conductor casing is no longer serviceable in which case it also must be removed.

In another method of slot recovery it is possible to remove all of the casings above the sea bed including the old conductor which is first cut and removed. Then a deflecting tool such as a whipstock is used to drill a new well. This method however often creates unwanted and costly collisions with nearby bore holes since the number and proximity of bore holes at the sea bed may be numerous and tightly spaced thereby resulting in the risk of collisions taking place.

The first method described namely the milling method is very time consuming and expensive. In some cases the expense is so great it is not economically feasible to carry out the slot recovery.

The second method using the deflecting tool or whipstock brings with it high risk of collisions with neighbouring well bores and therefore may not be suitable depending upon the density of well bores at the sea bed.

Therefore there is a need for a slot recovery method which is more efficient, can be completed in a shorter period of time, is environmentally friendly, provides for good well integrity and minimizes the risk of collisions.

SUMMARY OF THE INVENTION

The present concept is a method of slot recovery comprising the steps of:

A method of slot recovery for offshore drilling programs comprising the steps of:

a) running an internal cutter down a production casing to laterally cut through a preselected number of existing casings in a casing string at a predetermined depth;

b) drilling around the outermost casing of the preselected casings in the casing string with a hollow drill bit which is attached to core over casings, the hollow drill bit drills through the casing cement of the outermost casing of the preselected casings down to the predetermined depth;

c) attaching a removal tool to the inside of the production casing and remove the preselected existing casings to the predetermined depth to the surface;

d) repeat the above steps using appropriately sized hollow drill bits and core over casings, to drill around the outermost casing of the next preselected number of casings to a next predetermined depth to continue to remove existing casings until all preselected existing casings are removed to predetermined depths.

Preferably further including the step of:

The method of slot recovery claimed in claim 1 further including the step of:

e) placing new casing using conventional techniques

Preferably further including the step of:

The method of slot recovery claimed in claim 1 wherein the removal tool is a casing spear.

Preferably further including the step of:

The method of slot recovery claimed in claim 1 wherein the internal cutter is a multi-string cutter for milling laterally through preselected number of casings in a multiple string of casings Preferably further including the step of:

The method of slot recovery claimed in claim 1 wherein the existing casings are concentrically extending multi-string casings selected from among, production casings, intermediate casings and conductor casings to at least the first predetermined depth.

Preferably further including the step of:

The method of slot recovery claimed in claim 1 wherein the preselected existing casings are production casings and intermediate casings leaving the conductor casing in place to at least the first predetermined depth.

Preferably further including the step of:

The method of slot recovery claimed in claim 1 wherein the preselected existing casing is production casings leaving the conductor casing in place to at least the first predetermined depth.

Preferably further including the step of:

The method of slot recovery claimed in claim 1 wherein the preselected existing casings are production casings and intermediate casings and conductor casings thereby removing all casings to at least the first predetermined depth Preferably further including the step of:

The method of slot recovery claimed in claim 1 wherein the hollow drill bit is selected from among carbide, polycrystalline diamond compact, and or diamond impregnated style bit.

Preferably further including the step of:

The method of slot recovery claimed in claim 1 wherein the hollow drill bit is attached to appropriately sized core over casings, is connected to the drill string using a cross over sub assembly.

Preferably further including the step of:

The method of slot recovery claimed in claim 10 wherein drill collars are added to the drill string as needed to provide enough weight on the hollow drill bit using conventional techniques.

Preferably further including the step of:

The method of slot recovery claimed in claim 1 wherein the internal cutter is a multi-string cutter for milling laterally through multiple strings of casings, wherein the first predetermined depth cut is carried out at a conductor depth.

Preferably further including the step of:

The method of slot recovery claimed in claim 1 wherein the internal cutter is a multi-string cutter for milling laterally through multiple strings of casings, wherein the second predetermined depth cut is carried out at an intermediate cut.

Preferably further including the step of:

The method of slot recovery claimed in claim 8 further including the step of:

e) installing a spot cement plug above last existing casings for further well bore activity.

Preferably further including the step of:

The method of slot recovery claimed in claim 8 further including the step of:

e) installing a new conductor shoe on the spot cement plug and installing new conductor casing using conventional techniques.

Preferably further including the step of:

The method of slot recovery claimed in claim 15 further including the step of:

f) drilling a new hole through the cement plug and placing new casing using conventional techniques.

Preferably further including the step of:

The method of slot recovery claimed in claim 15 further including the step of:

g) drilling a new hole through the cement plug by side tracking below the new conductor shoe using conventional techniques.

Preferably further including the step of:

The method of slot recovery claimed in claim 1 further including the step a' prior to a of:

a') remove all casing to the sea bed using conventional techniques.

Preferably further including the step of:

The method of slot recovery claimed in claim 1 further including the step of:

e) decommissioning the existing production casing below the last lateral cut using conventional techniques.

Preferably further including the step of:

The method of slot recovery claimed in claim 1 further including the step of:

e) drilling a new hole by side tracking through the conductor casing using conventional side tracking techniques.

BRIEF DESCRIPTION OF THE DRAWINGS

The present concept will now be described by way of example only with reference to the following drawings in which.

DETAILED DESCRIPTION OF THE PREFERRED EMBODIMENT

Definitions

Drill string: A drill string on a drilling rig is a column of drill pipe that transmits drilling fluid and torque to the drill bit.

String of casings: May refer to a number of concentrically run casings normally including production casing, intermediate casing and the outer most conductor casing.

Slot recovery: is the process of making a plugged or, nonproducing well slot useable again to drill for additional resources from the same or existing surface structure.

Hollow drill bit: a drill bit designed and sized to drill around an existing casing and in particular sized and designed to drill through the outer cement surrounding the existing casing. The hollow drill bit is attached to core over casings and dimensioned to drill around an existing casing, essentially swallowing it in the process.

Cross over subassembly: a connector of two components in the present case to connect the core over casing to the drill string. The core over casing is attached to the hollow drill bit.

Whipstock: a deflecting tool used for example for side tracking

Internal cutter: cutter which is fed down the casing for making lateral cuts through one or more casings in a casing string. It may be a milling type cutter, or an explosive or water jet or any other type known in the industry Core over casing: casing sized to fit concentrically over an existing casing and in this case for attachment to a hollow drill bit.

Casing spear: also sometimes referred to a fishing spear is a tool which attaches to the inside of a casing for removal of the casing Multi-string cutter: a cutter that has multiple arm lengths so that it can be used to cut multiple sizes of casing.

Conductor cut: a lateral cut through the casing string cutting the production casing an intermediate casing and the conductor casing at a predetermined depth.

Intermediate cut: a lateral cut through the casing string cutting at least the production casing and the intermediate casing at a predetermined depth.

DESCRIPTION

Figure 10:
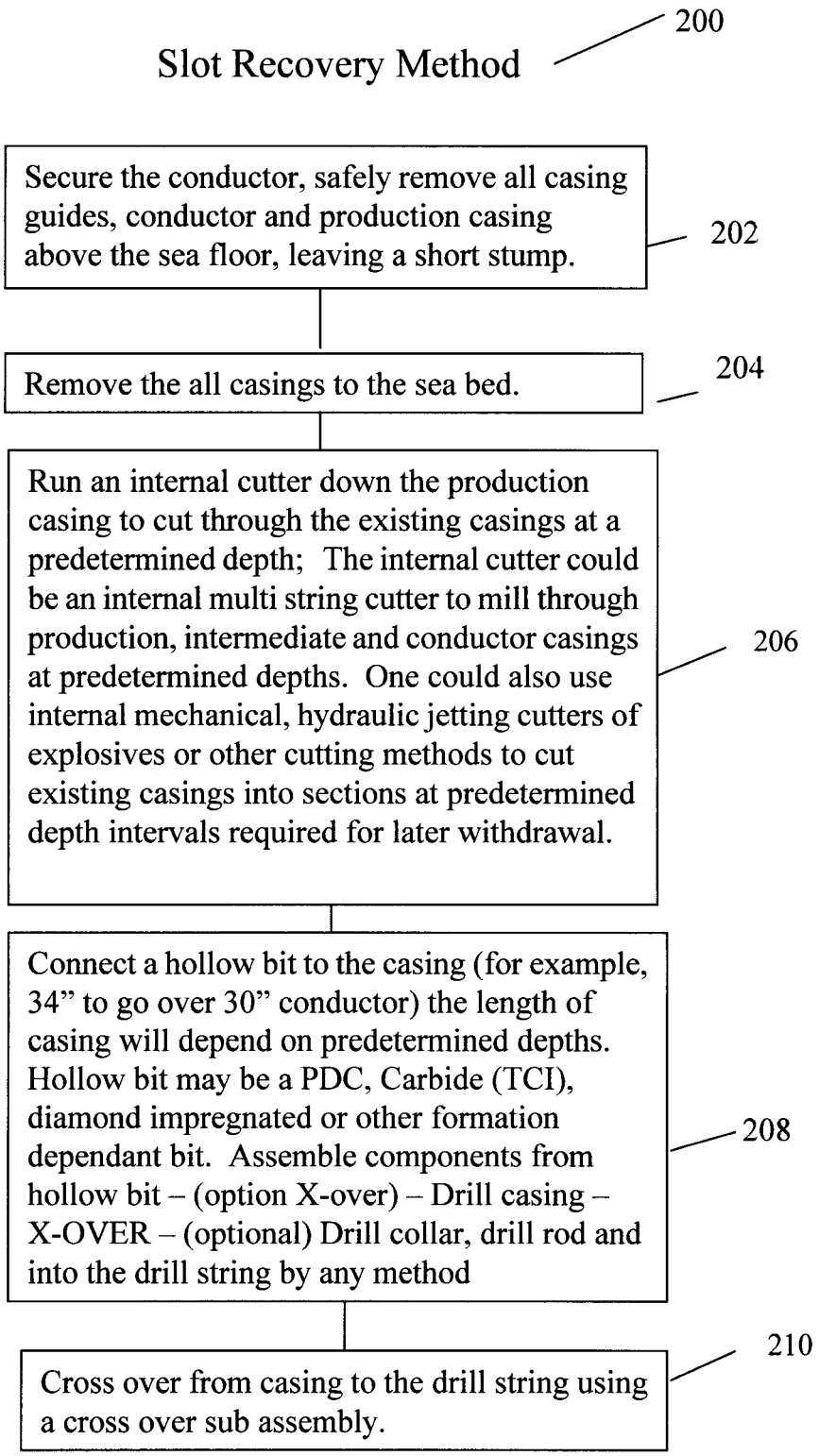
FIG. 10 is a flowchart diagram showing the steps in the slot recovery method when all of the casings are to be removed.
Figure 10:
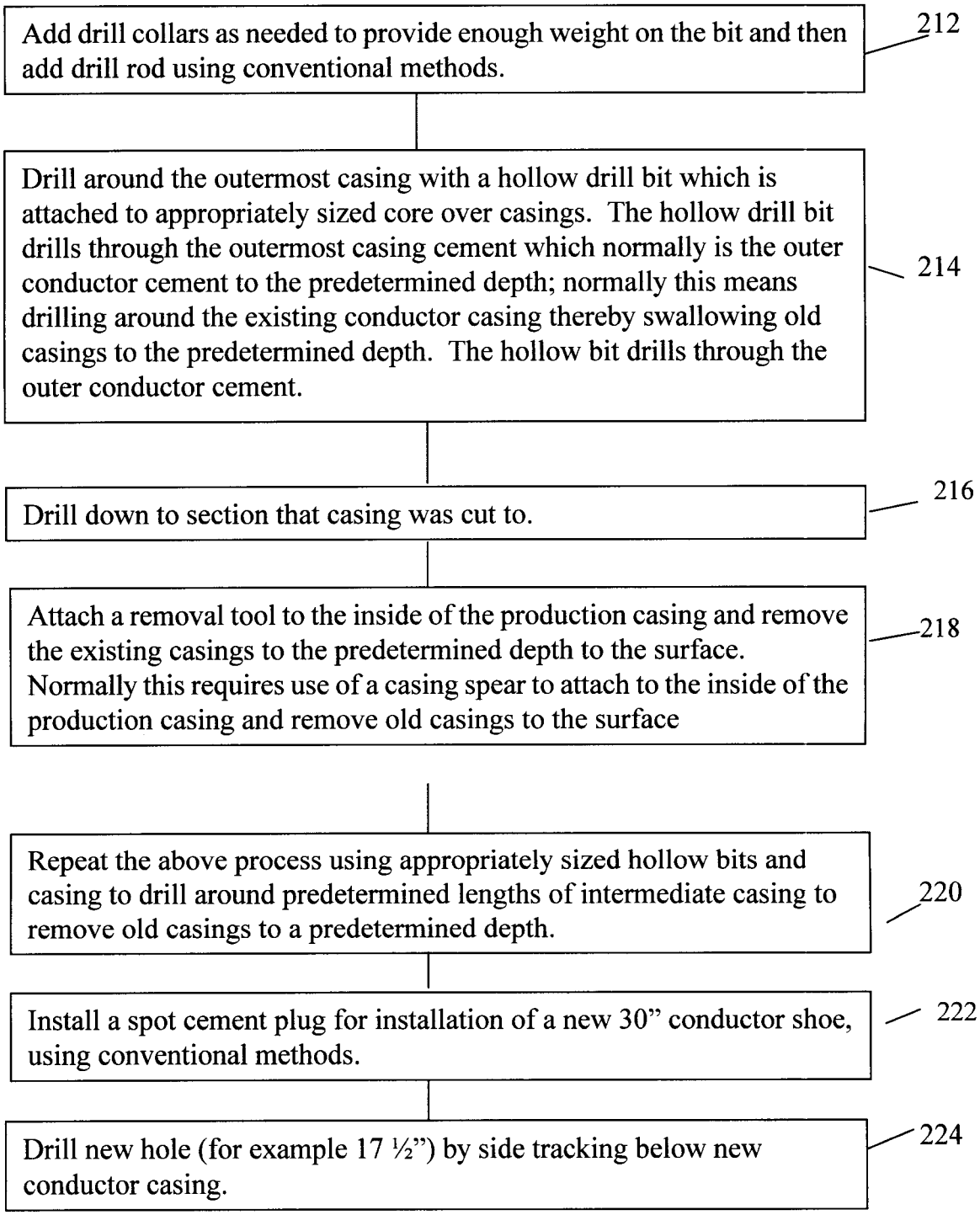
Figure 13:
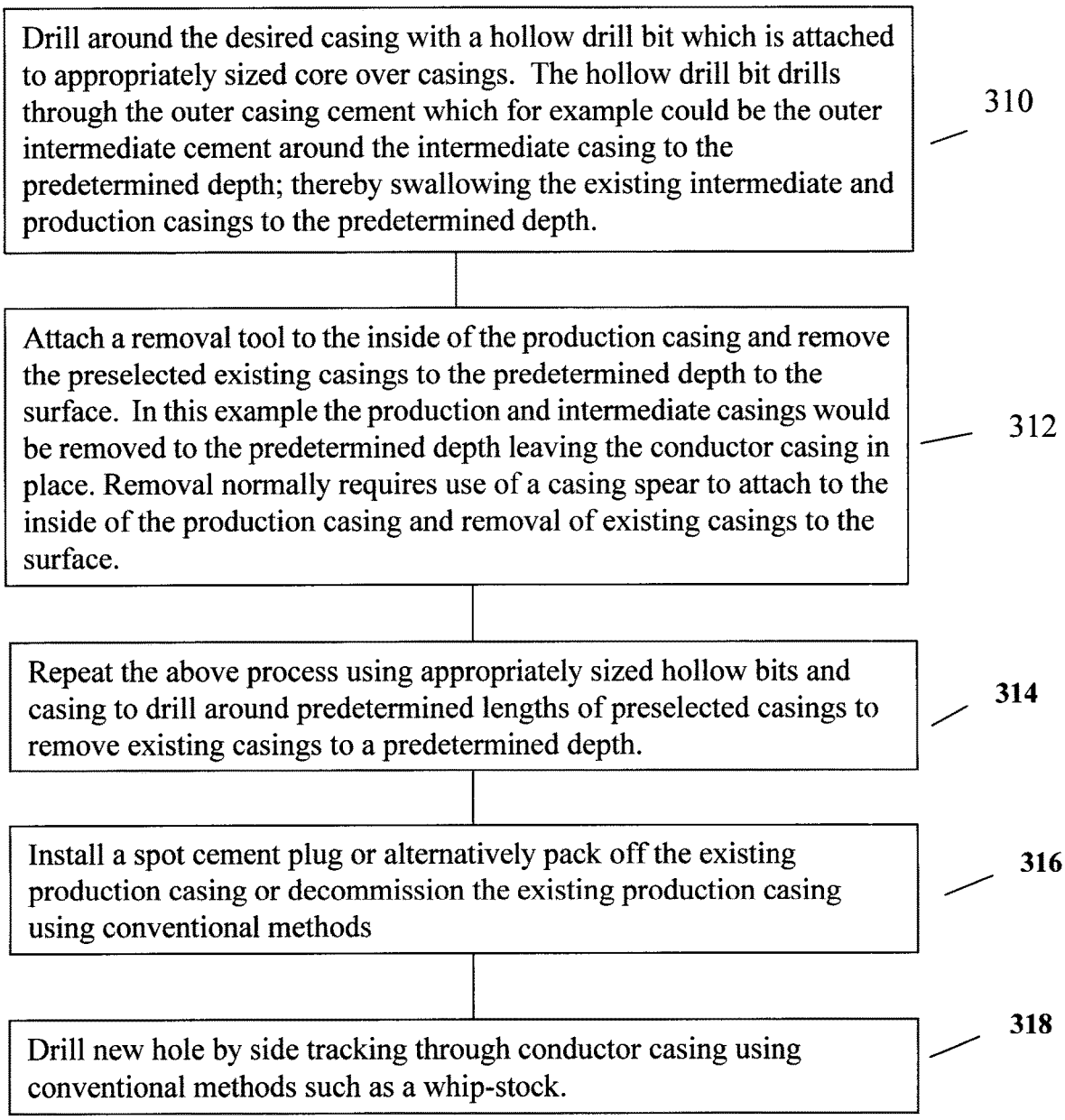
FIG. 13 is a flowchart diagram showing the steps in the slot recovery method when the inner strings of casings are to be removed and the existing outer most conductor casing remains in place.

Referring first of all to FIG. 13 the present concept a slot recovery method is shown in flowchart format in FIG. 10 as slot recovery method 300 and has the following steps:

Run an internal cutter down the production casing to cut through preselected number of existing casings in a casing string at a predetermined depth. The internal cutter could be an internal multi string cutter to mill through production and intermediate casings and not for example cut the existing conductor casing. The internal cutter nay be an internal mechanical cutter, hydraulic jetting cutter or explosives or other cutting methods used to laterally cut existing casings into sections at predetermined depths intervals required for later withdrawal shown as 302.

Connect the hollow drill bit to core over casings. The length of the core over casings will depend on the predetermined depths. The hollow drill bit may be a PDC, Carbide (TCI), diamond impregnated or other formation dependent drill bit shown as 304.

Assemble components from hollow drill bit, core over casing and optionally a cross over subassembly to cross over to the drill string in which case one can add drill collars, drill rod and use the drill string in the conventional method Add drill collars as needed to provide enough weight on the bit and then add drill rod using conventional methods shown as 306.

Provided the intermediate casing is not too far off center one can drill around the intermediate casing, using an appropriately sized hollow drill bit, down to the predetermined depth leaving the existing conductor casing in place shown as 308.

Drill around the desired casing with a hollow drill bit which is attached to appropriately sized core over casings. The hollow drill bit drills through the outer casing cement which for example could be the outer intermediate cement around the intermediate casing to the predetermined depth; thereby swallowing the existing intermediate and production casings to the predetermined depth shown as 310.

Attach a removal tool to the inside of the production casing and remove the preselected existing casings to the predetermined depth to the surface. In this example the production and intermediate casings would be removed to the predetermined depth leaving the conductor casing in place. Removal normally requires use of a casing spear to attach to the inside of the production casing and removal of existing casings to the surface shown as 312.

Repeat the above process using appropriately sized hollow bits and casing to drill around predetermined lengths of preselected casings to remove existing casings to a predetermined depth shown as 314.

Install a spot cement plug or alternatively pack off the existing production casing or decommission the existing production casing using conventional methods shown as 316.

Drill a new hole by side tracking through conductor casing using conventional methods such as a whip-stock shown as 318.

Using this hollow drill bit process the existing conductor casing 106 can be left in place and used to install new production casings and also intermediate casings if needed. In the case where the conductor casing is to badly corroded or unserviceable for other reasons or the inner string is not substantially concentric with the conductor casings it may be necessary to remove the conductor casing as well as described below.

The reader should note that FIGS. 1 to 8 depict the removal of the conductor casing 106 intermediate casings 110 and production casings 114. Essentially all of the casings in the string. In many cases it may not however be necessary to remove all of the casings in which case the preselected number of existing casings could include only the intermediate casings 110 and production casings 114 or just the production casings. The number of preselected casings depends on the condition of the casings the end result to be achieved and will vary from case to case.

Additionally the location of lateral cuts at predetermined depths such as the conductor depth 108 may depend upon how deep the casings extend or limitations imposed by the drilling equipment capacities on the drill platform such as the maximum weight which can be retrieved by the casing spear.

FIG. 10 depicts in flowchart form slot recovery method 200 which is applied when removal of all existing casings is required. The steps are as follows:

Secure the conductor and casings above the sea bed and safely remove all casing guides, conductor and production casing above the sea floor leaving a short stump shown as 202.

Remove all casings to the sea bed shown as 204.

Run an internal cutter down the production casing to cut through the existing casings at a predetermined depth; The internal cutter could be an internal multi string cutter to mill through production, intermediate and conductor casings at predetermined depths. One could also use internal mechanical, hydraulic jetting cutters of explosives or other cutting methods to cut existing casings into sections at predetermined depth intervals required for later withdrawal shown as 206.

Connect a hollow bit to hollow bit core over casing for example a 34 inch casing to go over a 30 inch conductor wherein the length of the casing will depend on the predetermined depth. The hollow bit may be a PDC type bit, a carbide type bit, diamond impregnated or other formation dependant style bit.

Assemble the components namely the hollow bit, the hollow bit core over casing and the cross over casing to drill string sub assembly and continue on the drill string with drill rod using any conventional method. Shown as 208.

Cross over from the casing to the drill string using the cross over sub assembly shown as 210.

Add drill collars as needed to provide enough weight on the bit and then add drill rod using conventional methods shown as 212.

Drill around the outermost casing with a hollow drill bit which is attached to appropriately sized core over casings. The hollow drill bit drills through the outermost casing cement which normally is the outer conductor cement to the predetermined depth; normally this means drilling around the existing conductor casing thereby swallowing old casings to the predetermined depth. The hollow bit drills through the outer conductor cement. Shown as 214.

Drill down to section that casing was cut to shown as 216.

Attach a removal tool to the inside of the production casing and remove the existing casings to the predetermined depth to the surface. Normally this requires use of a casing spear to attach to the inside of the production casing and remove old casings to the surface shown as 218.

Repeat the above process using appropriately sized hollow bits and casing to drill around predetermined lengths of conductor casing, intermediate casing to remove old casings to a predetermined depth shown as 220.

Install a spot cement plug for installation of an new 30 inch conductor shoe using conventional methods shown as 222.

Drill a new hole for example a 17.5 inch by side tracking below the newly installed conductor casing shown as 224.

Referring now to FIGS. 1 through 8 which schematically depict the steps and equipment used in the slot recovery method 200 described above.

Figure 1:
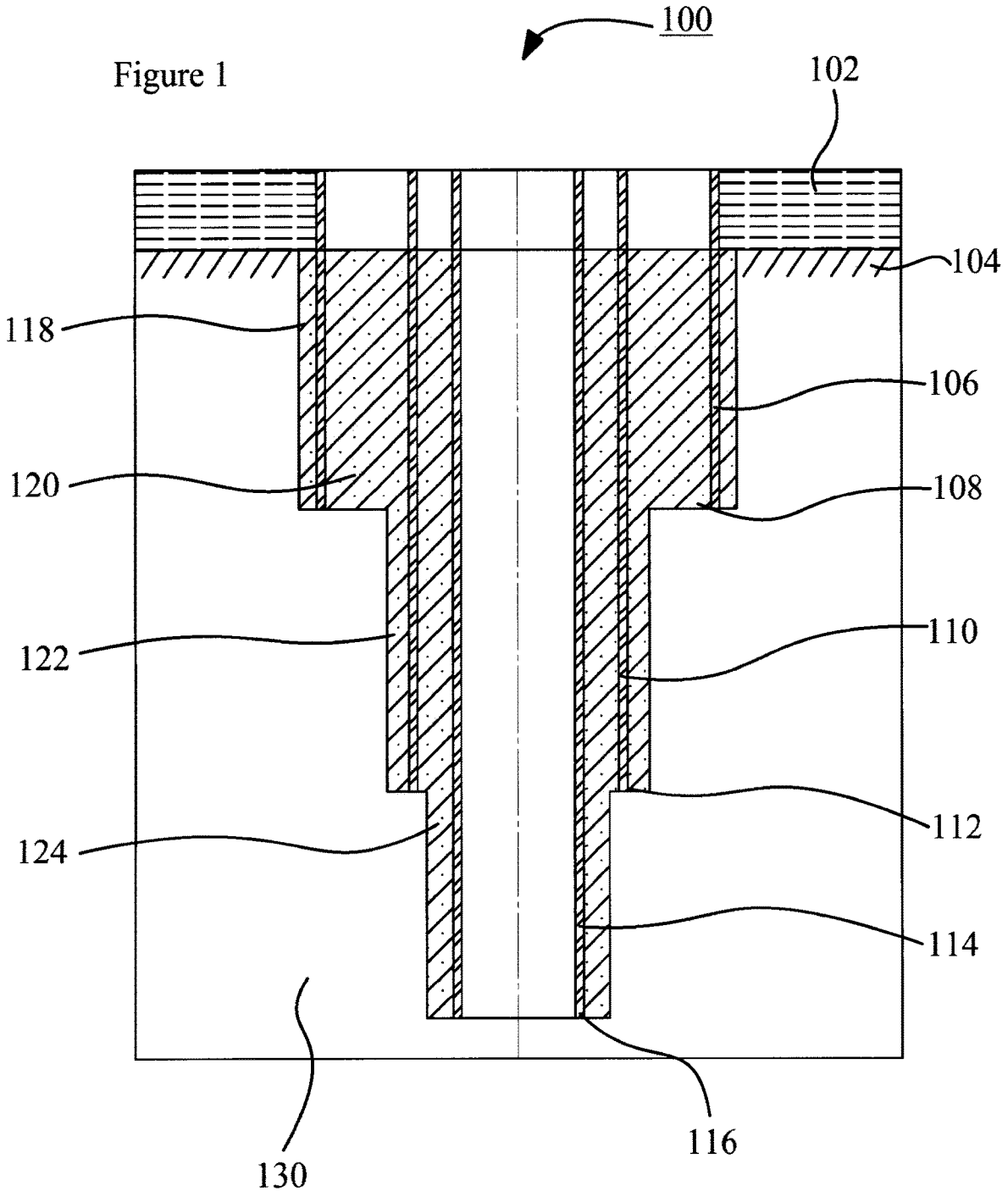
FIG. 1 is a schematic cross sectional view of a single off shore well bore showing the arrangement of casings below the well head.

FIG. 1 is a schematic cross sectional view of existing casings below the well head shown generally as 100.

FIG. 1 depicts in cross sectional schematic view a sub-sea well bore which would include water 102 above the sea bed 104 and conductor casing 106 run down to a depth of conductor depth 108 and an intermediate casing 110 down to a depth of intermediate depth 112 and production casing 114 down to a production depth 116.

The casings including conductor casing 106, intermediate casing 110 and production casing 114 are normally cemented in place and the diagram shows outer conductor cement 114 around the outside diameter of conductor casing 106 cement 120 generally between the casings, outer intermediate cement 122 around the outer diameter of intermediate casing 110 and outer casing cement 124 around the outer diameter of production casing 114.

The diameter of conductor casing 106 and the conductor depth 108 as well as the diameters of the intermediate casing 110 and the intermediate depth 112 and the diameter production casing 114 and the production depth 116 will to some extent be dependant upon the ground formation 130 and the type of casing requirements necessary in order to provide for a stable well bore.

FIG. 1 depicts a typical arrangement in which there is by way of example only, a large conductor casing 106 having a nominal outer diameter of 30 inches, an intermediate casing 110 having a nominal outer diameter of 13 and $3/8^{th}$ inches and a production casing 114 having a nominal outer diameter of 9 and $5/8^{th}$ inches.

Production tubing would be installed inside the last casing string namely in this case the production casing 114.

FIGS. 1 through 8 only show the casings below the well head.

Figure 2:
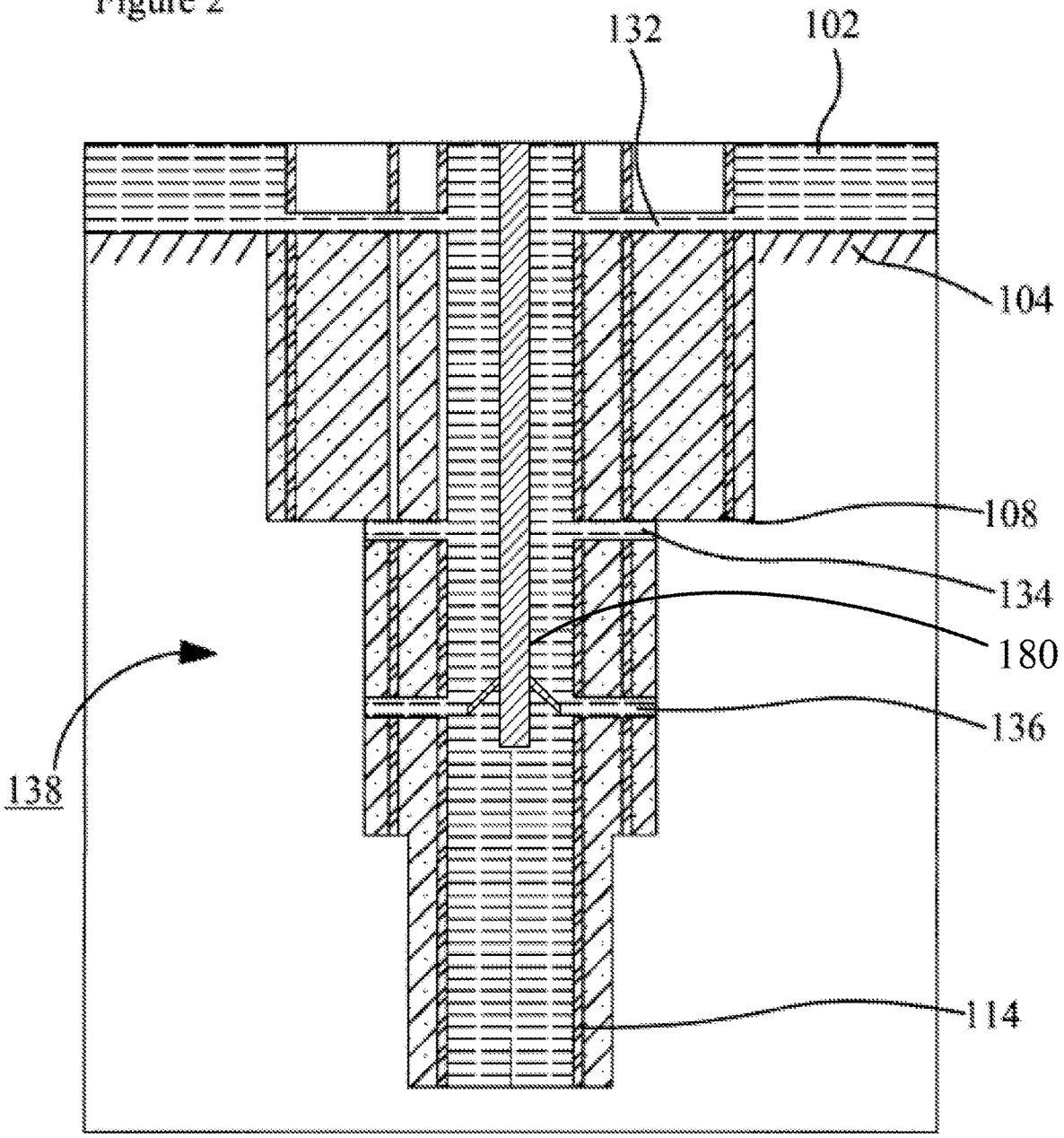
FIG. 2 is the same schematic cross sectional view as shown in FIG. 1 with additional casing cuts taken along the sea bed, a conductor cut and an intermediate cut.

Referring now to FIG. 2 an internal multi string cutter 180 is run through the production casing 114 and is used to cut through one of more of the casings depending on the depth in order to be able to remove the casings in manageable pieces.

Therefore by way of example only a multi string cutter is used to make a cut at the sea bed cut 132 which cuts through the conductor casing 106, the intermediate casing 110 and the production casing 114.

FIG. 2 further depicts a conductor cut 134 which cuts through the intermediate casing 110 and the production casing 114 at the conductor depth 108.

FIG. 2 further shows intermediate cut 136 which also cuts through the intermediate casing 110 and the production casing 114.

By way of example only conductor casing 108 may be down to a depth of 350 feet, intermediate casing 110 may be down to a depth of 3,000 feet, and production casing 114 may go down to a depth of 8,000 feet. These are only examples of typical lengths which are seen in the drill field.

Depending upon the length of the conductor casing 106 one or more lateral cuts shown in FIG. 2 may be made through the three strings of casings in order to be able to manageably lift those sections of strings to the surface.

FIG. 2 only shows three cuts however in reality there may be multiple cuts at regular intervals along the casing string wherein manageable pieces of the casing string are cut for bringing upwards to the surface.

Figure 3:
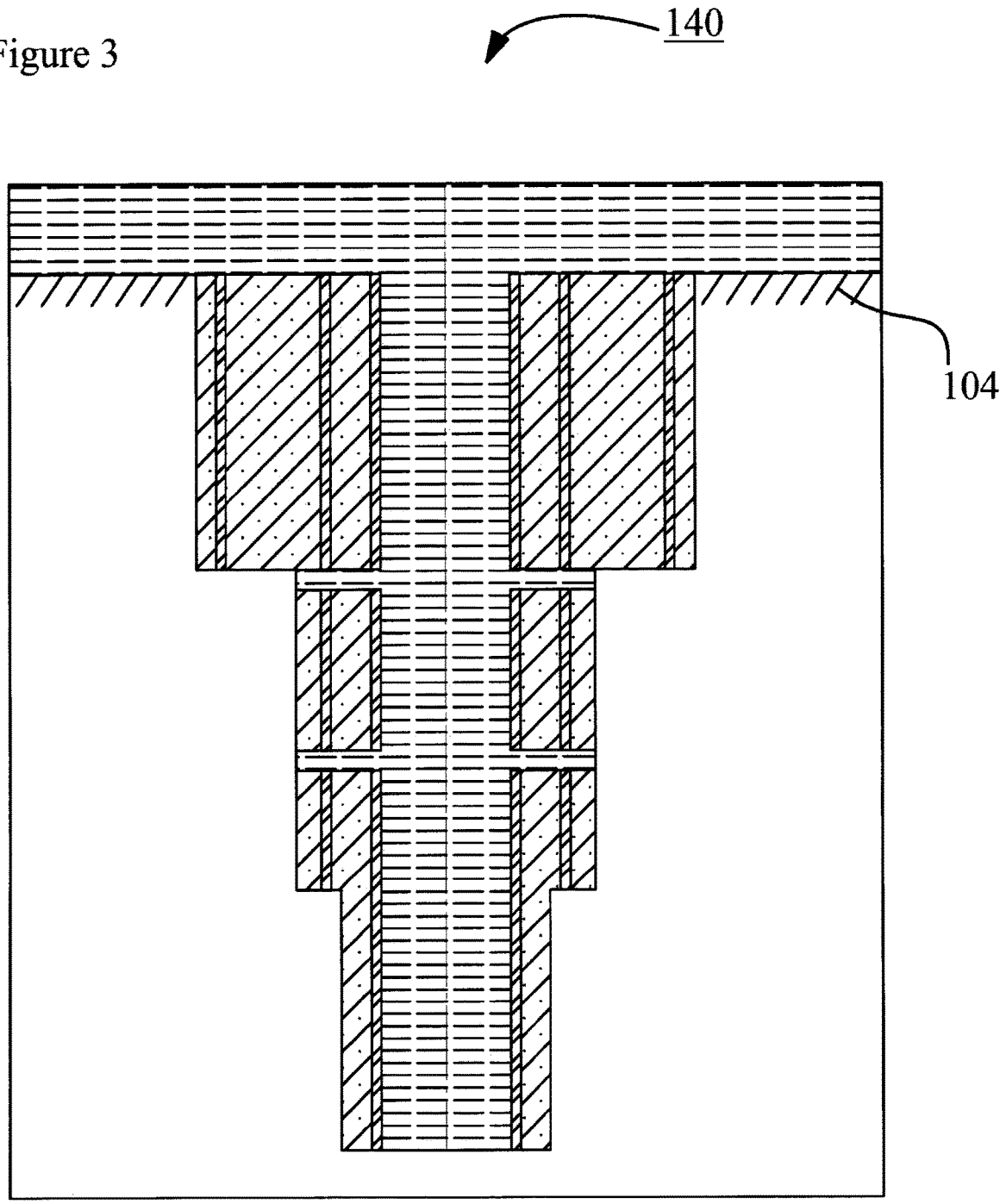
FIG. 3 is a schematic cross sectional view of a single off shore well bore as shown in FIGS. 1 and 2 with the casings above the sea bed removed.

Referring now to FIG. 3 the casings above the sea bed are removed as shown as 140 leaving behind a little or short stump on or near the sea bed 104.

Figure 4:
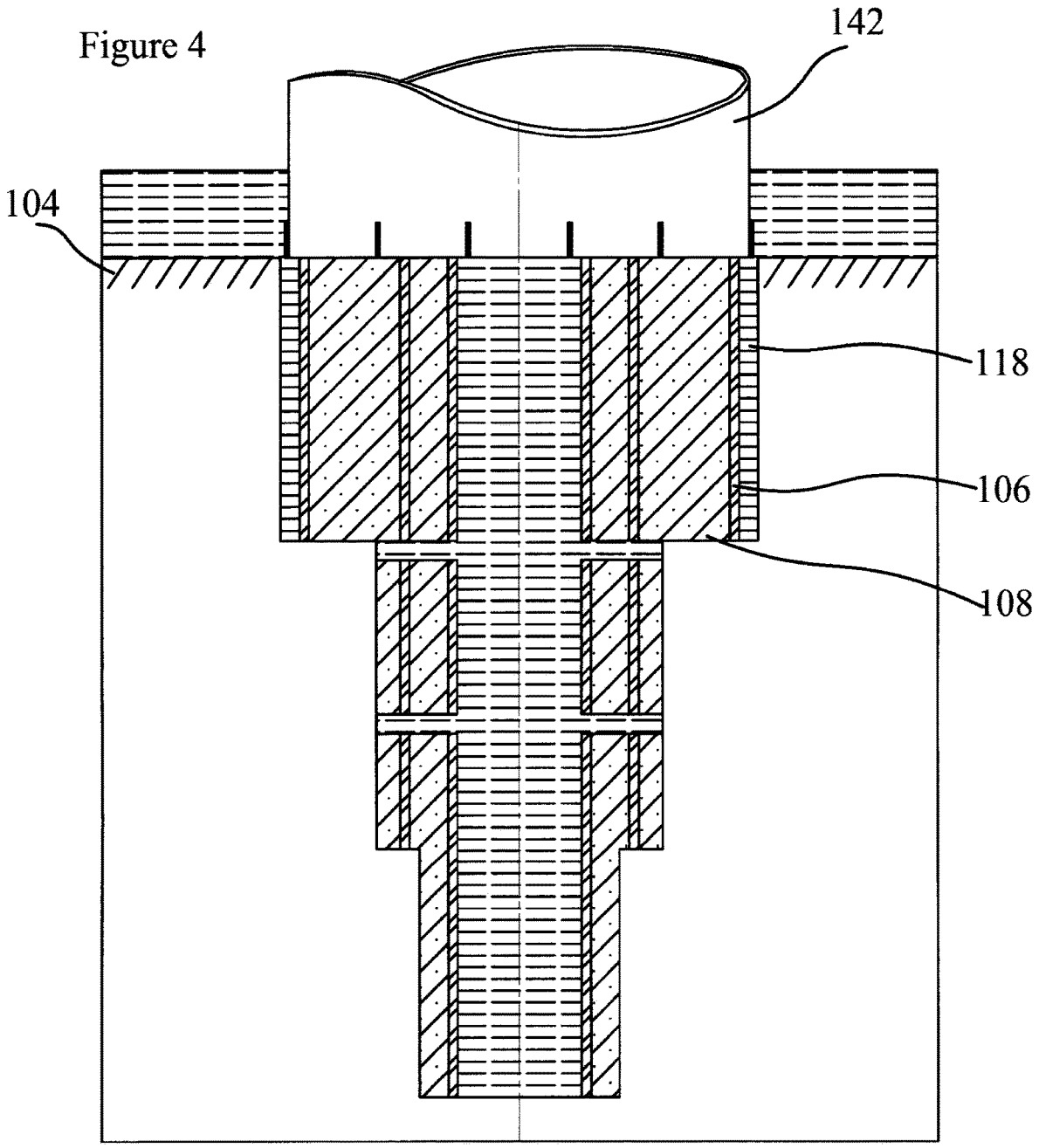
FIG. 4 is a schematic cross sectional view of a single off shore well bore as shown in FIG. 3 however with the addition of a hollow bit drill shown boring down around the outer conductor casing through the outer conductor cement thereby "swallowing" the existing casings.

Referring now to FIG. 4 which shows a hollow bit drill 142 drilling through the outer conductor cement 118 of the outer conductor casing 106 until it reaches conductor depth 108. Further explanation of the hollow bit drill is given in FIG. 9 below.

Figure 5:
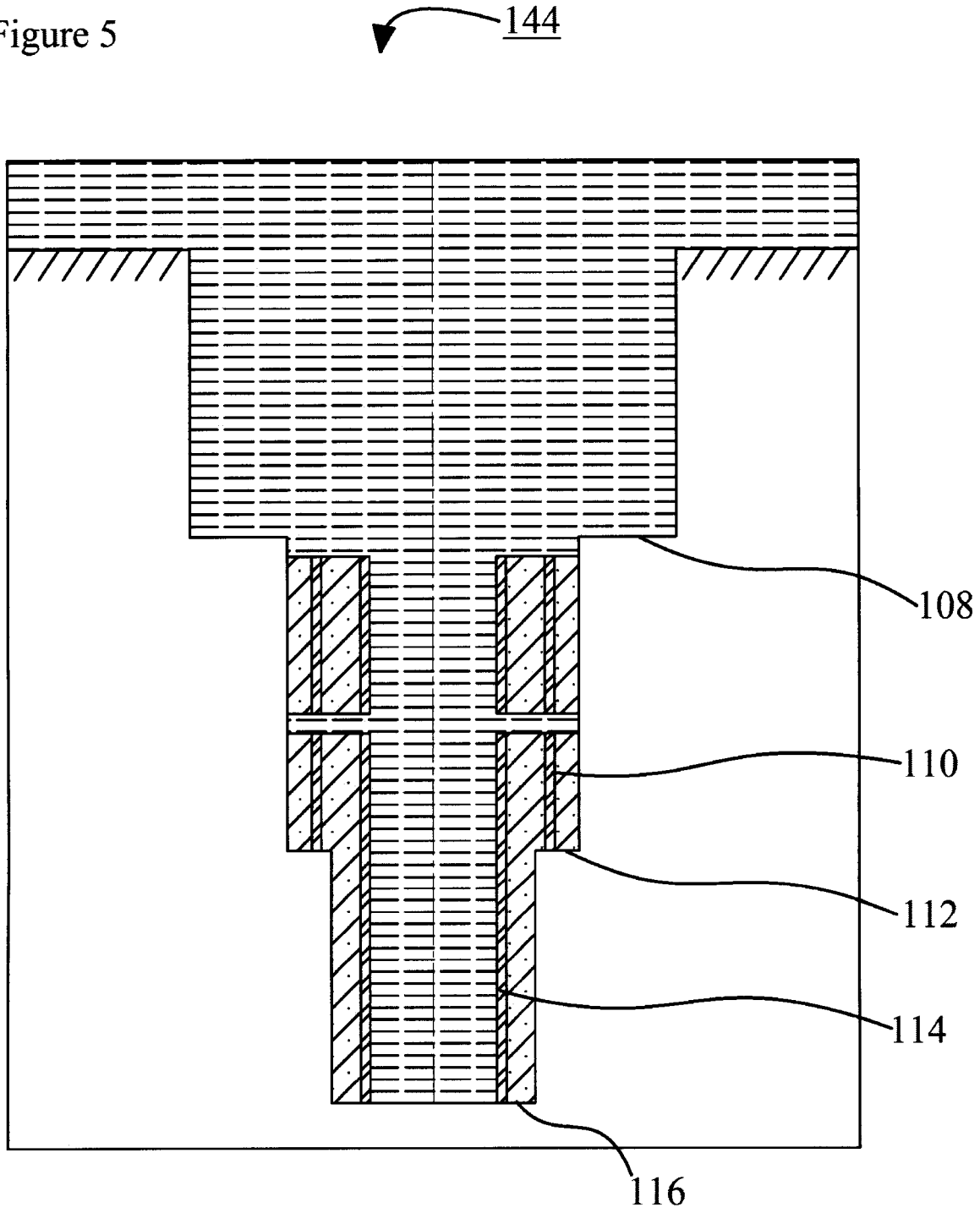
FIG. 5 is a schematic cross sectional view of a single offshore well bore showing the casings removed to a conductor depth.

Referring now to FIG. 5 once the outer conductor cement 118 has been drilled through and swallowed up by hollow bit drill 142 the remaining casing string can be pulled to the surface and the existing conductor casings removed as shown in FIG. 5 and denoted as 144.

Figure 6:
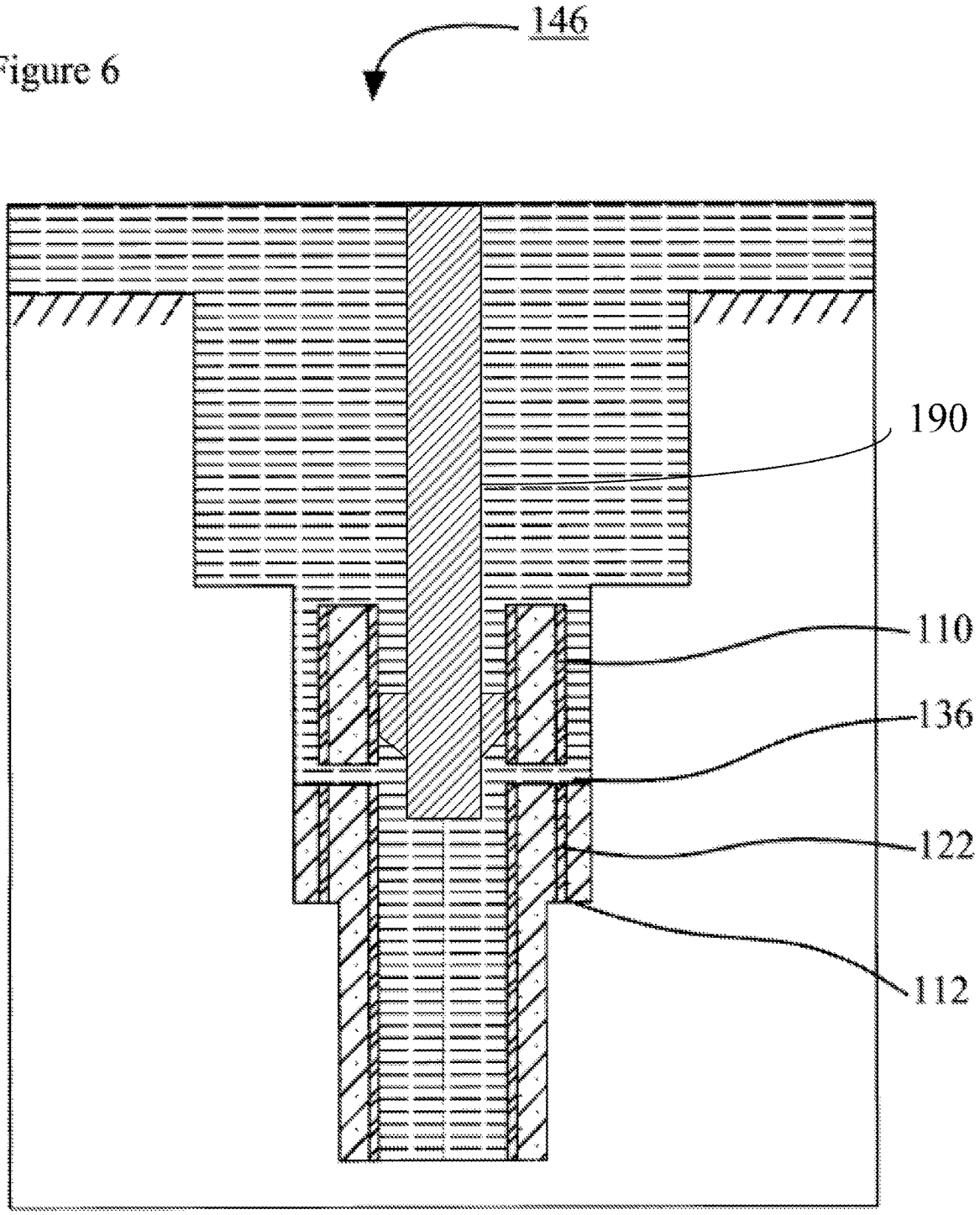
FIG. 6 is a schematic cross sectional view of a single offshore well bore showing a portion of the outer intermediate cement being drilled away using a hollow bit drill.

Referring now to FIG. 6 cement around intermediate casing namely intermediate cement 122 is drilled shown as 146 in order to achieve this a smaller diameter hollow bit than what is depicted in FIG. 4 is used to drill through the outer intermediate cement 122 surrounding intermediate casing 110 to a depth of the intermediate cut 136.

Figure 7:
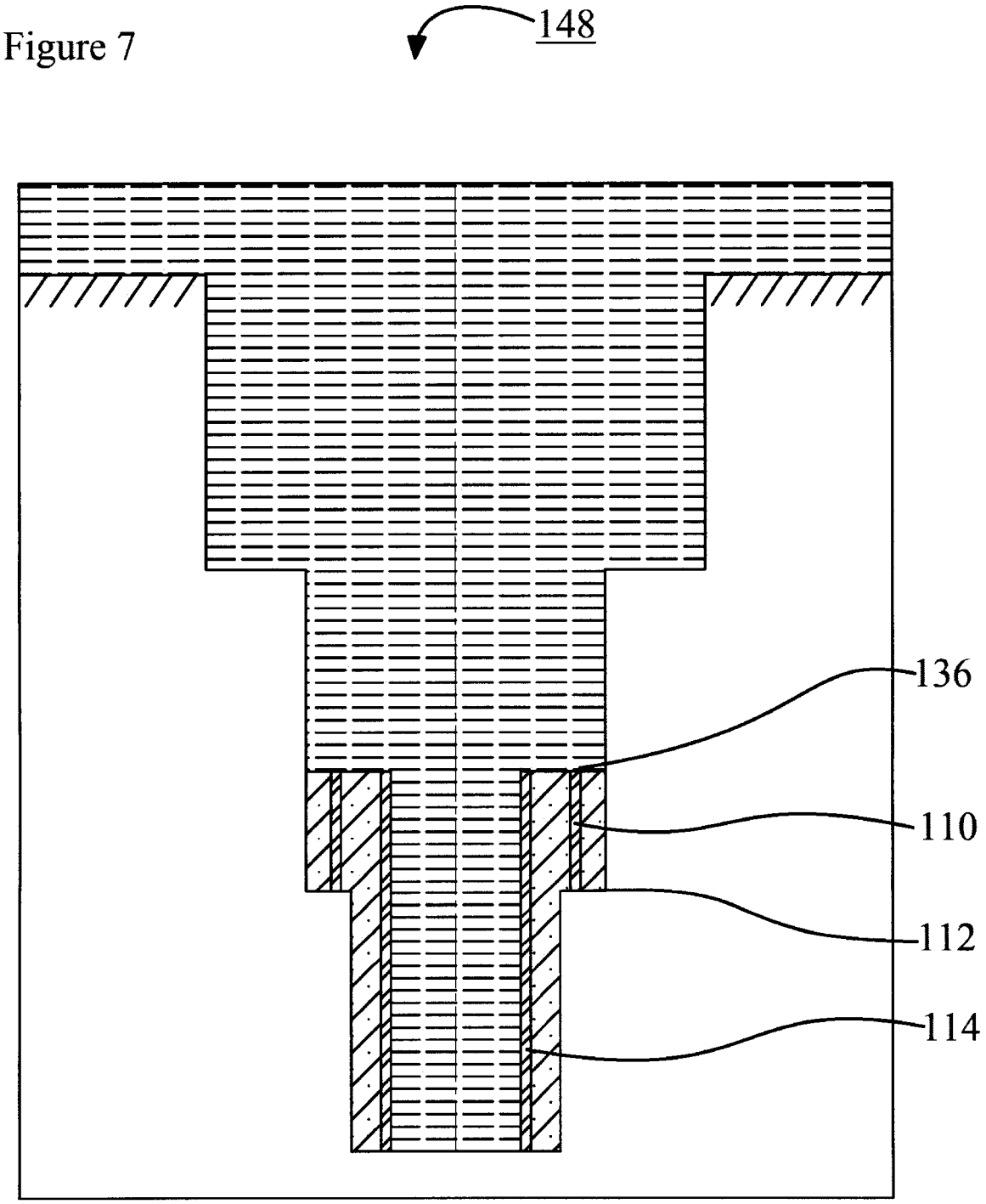
FIG. 7 is a schematic cross sectional view of a single offshore well bore showing the intermediate casing and production casing having been removed to the intermediate cut level.

Once the outer intermediate cement 122 is removed using the hollow bit technique the remaining casing string can be removed with the removal tool 190. Shown in FIG. 7 is a portion of intermediate casing removed 148 wherein now all of the existing old string of casings has been removed down to the intermediate cut point 136.

Figure 8:
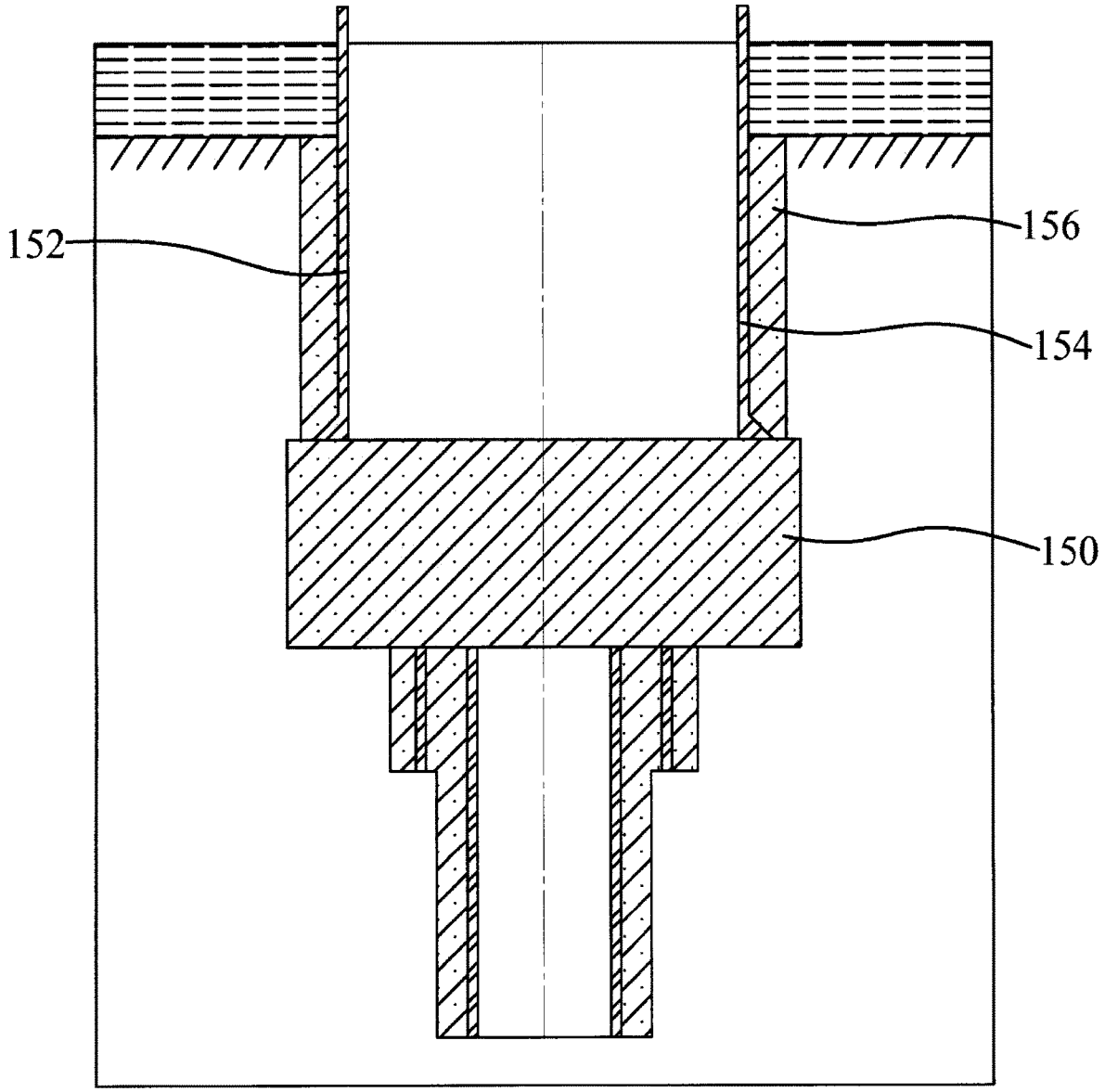
FIG. 8 is a schematic cross sectional view of a single offshore well bore shown with a cement plug put into position over top of the old casings and a new conductor shoe placed onto the cement plug and cemented in place with conductor cement.

FIG. 8 schematically shows the installation of a spot cement plug 150 and a new conductor shoe 152 placed on cement plug 150 and new conductor casing 154 placed down bore hole and new conductor cement 156 placed to stabilize the new conductor casing 154.

The reader will note that once the new conductor casing 154 is placed upon the cement plug 150 it is possible now to drill a new hole by side tracking below the new conductor casing which is not shown in the diagrams but well known in the art. In addition new intermediate casings and production casings can be installed similar to the pre-existing condition which was shown in FIG. 1 above cement plug 150.

Figure 9:
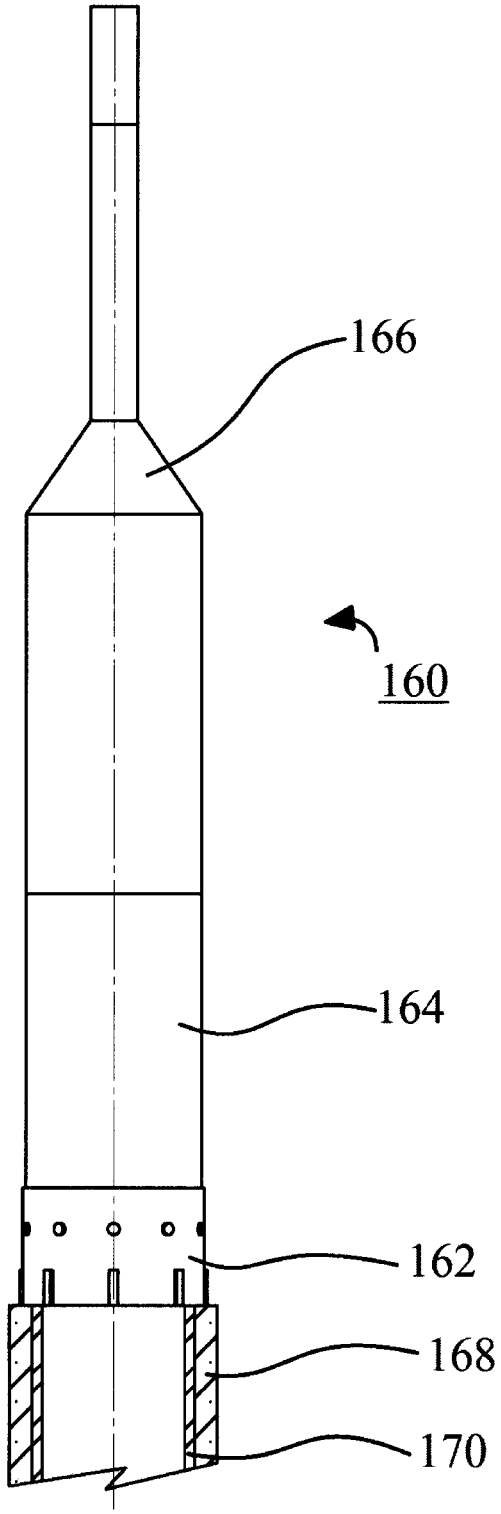
FIG. 9 is a schematic view of a hollow bit drill consisting of a hollow bit, hollow bit core over casings and a cross over casing to drill string sub assembly. The hollow bit drill is shown deployed together with a conductor casing which has been cemented in whereby the hollow bit drill is drilling around the conductor casing through the conductor cement thereby swallowing the conductor casing.

FIG. 9 depicts a hollow bit drill 160 which includes a hollow bit also referred to as hollow drill bit 162 hollow bit core over casings 164 and a cross over casing to drill string sub assembly 166. Shown in FIG. 9 is the hollow bit drill 160 drilling down through conductor cement 168 swallowing conductor casing 170.

The cross over casing to drill bit string sub assembly 166 allows one to cross over from the casing to the drill string using this cross over sub assembly 166. The length of the hollow bit core over casing 164 may be as long as necessary to reach lateral cuts such as conductor cut 134 at a predetermined depth such as conductor depth 108. A sample of a hollow bit drill 160.

The size of the hollow bit is dependant upon the size of the conductor or casing that one is drilling around. For example for a 30 inch conductor will require a hollow drill bit 162 of approximately 34 inches.

Figure 11:
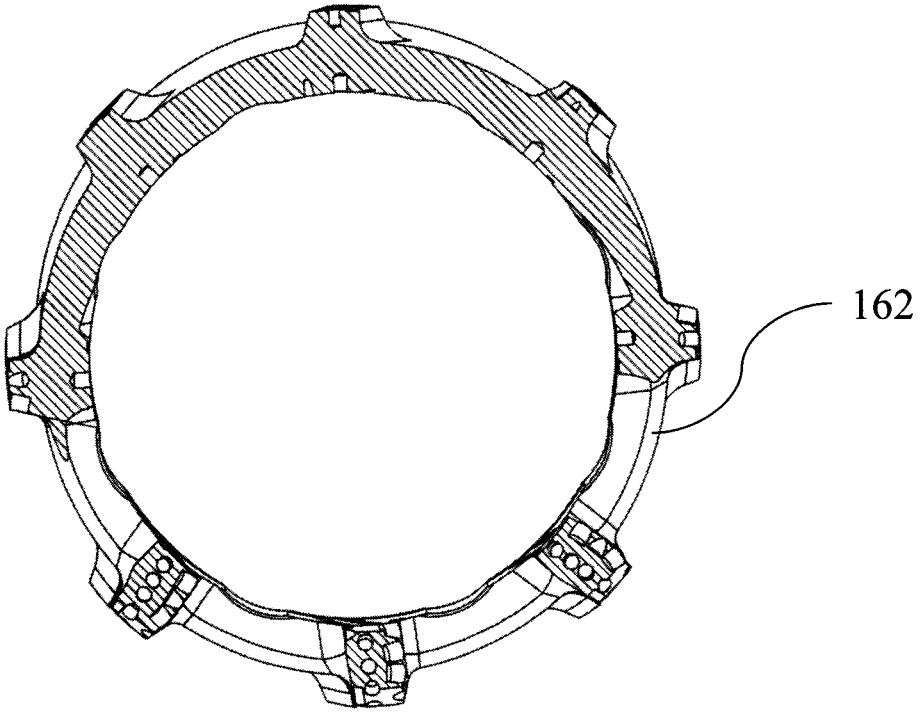
FIG. 11 is a top end view, partially cut away, of a hollow drill bit.
Figure 12:
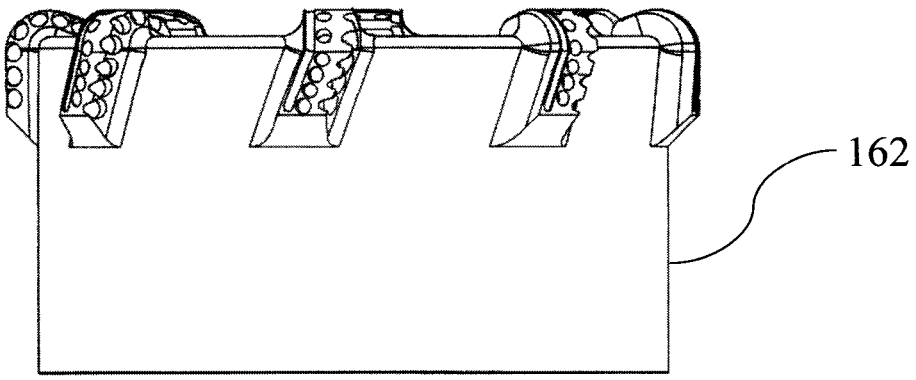
FIG. 12 is a side elevation view of a hollow drill bit.

FIGS. 11 and 12 depict a typical hollow drill bit 162 which is adapted to attach to core over casings 164 to drill down to a predetermined depth such as conductor depth 108. The hollow drill bit 162 could be made using polycrystalline diamond compact known as PDC's or carbide, diamond impregnated style bit.

It should be apparent to persons skilled in the arts that various modifications and adaptation of this structure described above are possible without departure from the spirit of the invention the scope of which defined in the appended claim.

I claim:

1. A method of slot recovery to remove multiple casings cemented in a well comprising the steps of:

a) running an internal cutter down a production casing to laterally cut through a preselected number of existing casings in a casing string at multiple predetermined depths, wherein the internal cutter is capable of cutting through casings of different diameters;

b) drilling around the outermost casing of a first number of casings of the preselected casings in the casing string with a hollow drill bit which is attached to a core over casing, the hollow drill bit drilling through the casing cement around the outermost casing of the first number of casings down to a first predetermined depth of the multiple predetermined depths;

c) attaching a removal tool to the first number of casings and removing the first number of casings from the first predetermined depth to the surface; and d) repeating steps b) and c) using appropriately sized hollow drill bits and core over casings to drill around the outermost casing of the next number of casings of the preselected number of casings to a next predetermined depth of the multiple predetermined depths to continue to remove existing casings until all preselected existing casings are removed from the multiple predetermined depths.

2. The method of slot recovery claimed in claim 1 further including the step of:

e) placing new casing using conventional techniques.

3. The method of slot recovery claimed in claim 1 wherein the removal tool is a casing spear.

4. The method of slot recovery claimed in claim 1 wherein the internal cutter is a multi-string cutter for milling laterally through the preselected number of casings in a multiple string of casings.

5. The method of slot recovery claimed in claim 1 wherein the existing casings are concentrically extending multi-string casings selected from among, production casings, intermediate casings and conductor casings to at least the first predetermined depth.

6. The method of slot recovery claimed in claim 1 wherein the preselected existing casings are production casings and intermediate casings, leaving a conductor casing in place to at least the first predetermined depth.

7. The method of slot recovery claimed in claim 1 wherein the preselected existing casing is production casings, leaving a conductor casing in place to at least the first predetermined depth.

8. The method of slot recovery claimed in claim 1 wherein the preselected existing casings are production casings, intermediate casings and conductor casings , thereby removing all casings to at least the first predetermined depth.

9. The method of slot recovery claimed in claim 1 wherein the hollow drill bit is selected from among carbide, polycrystalline diamond compact, and diamond impregnated style bits.

10. The method of slot recovery claimed in claim 1 wherein the hollow drill bit is attached to appropriately sized core over casings and is connected to a drill string using a cross over sub assembly.

11. The method of slot recovery claimed in claim 10 wherein drill collars are added to the drill string as needed to provide enough weight on the hollow drill bit using conventional techniques.

12. The method of slot recovery claimed in claim 1 wherein the internal cutter is a multi-string cutter for milling laterally through multiple strings of casings, wherein the first predetermined depth is at a conductor casing depth.

13. The method of slot recovery claimed in claim 1 wherein the internal cutter is a multi-string cutter for milling laterally through multiple strings of casings, wherein a second predetermined depth is at an intermediate cut.

14. The method of slot recovery claimed in claim 1 further including the step of:

e) installing a spot cement plug above last existing casings for further well bore activity.

15. The method of slot recovery claimed in claim 14 further including the step of:

f) installing a new conductor shoe on the spot cement plug and installing new conductor casing using conventional techniques.

16. The method of slot recovery claimed in claim 14 further including the step of:

f) drilling a hole through the cement plug and placing new casing using conventional techniques.

17. The method of slot recovery claimed in claim 14 further including the step of:

f) drilling a hole through the cement plug by side tracking using conventional techniques.

18. The method of slot recovery claimed in claim 1 further including the step a' prior to a of:

a') remove all casing to the sea bed using conventional techniques.

19. The method of slot recovery claimed in claim 1 further including the step of:

e) decommissioning an existing production casing below the last predetermined depth using conventional techniques.

20. The method of slot recovery claimed in claim 1 further including the step of:

e) drilling a new hole by side tracking through a conductor casing using conventional side tracking techniques.

* * * * *